United States Patent [19]

Barry et al.

[11] 4,046,085

[45] Sept. 6, 1977

[54] METHOD AND APPARATUS FOR TREATING WASTE MATERIAL IN A COUNTER-CURRENT INCINERATOR

[75] Inventors: Louis T. Barry, Skillman; Gordon W. Czop, Garfield, both of N.J.

[73] Assignee: Nichols Engineering & Research Corporation, Belle Mead, N.J.

[21] Appl. No.: 706,616

[22] Filed: July 19, 1976

[51] Int. Cl.[2] ..... F23G 5/04

[52] U.S. Cl. ..... 110/12; 202/117; 432/139

[58] Field of Search ..... 110/8 R, 8 C, 12; 432/18, 131, 139, 142; 201/44; 202/117

[56] References Cited

U.S. PATENT DOCUMENTS

| | | | |
|---|---|---|---|
| 2,147,152 | 2/1939 | Connolly | 110/12 |
| 3,379,622 | 4/1968 | Von Dreusche, Jr. | 202/117 |
| 3,905,757 | 9/1975 | Von Dreusche, Jr. | 432/18 |
| 3,958,922 | 5/1976 | Anderson | 110/12 |
| 3,994,829 | 11/1976 | Alford | 202/117 |

*Primary Examiner*—Kenneth W. Sprague
*Attorney, Agent, or Firm*—Edwin T. Grimes

[57] ABSTRACT

The present invention is directed to method and apparatus for treating waste material in a counter-flow furnace wherein the material is introduced at one end thereof and the processed material is discharged from the other end, while the gases of combustion are caused to flow in counter-current direction with respect to the material being processed and are exhausted at the first end of the furnace, and wherein the furnace has a natural tendency to form zones of processing including sequentially from the first end of the furnace, a drying zone, a charring and volatile burning zone, a fixed carbon burning zone and an ash cooling zone, a method characterized by the step of adding an oxidant including water vapor to the fixed carbon burning zone.

8 Claims, 1 Drawing Figure

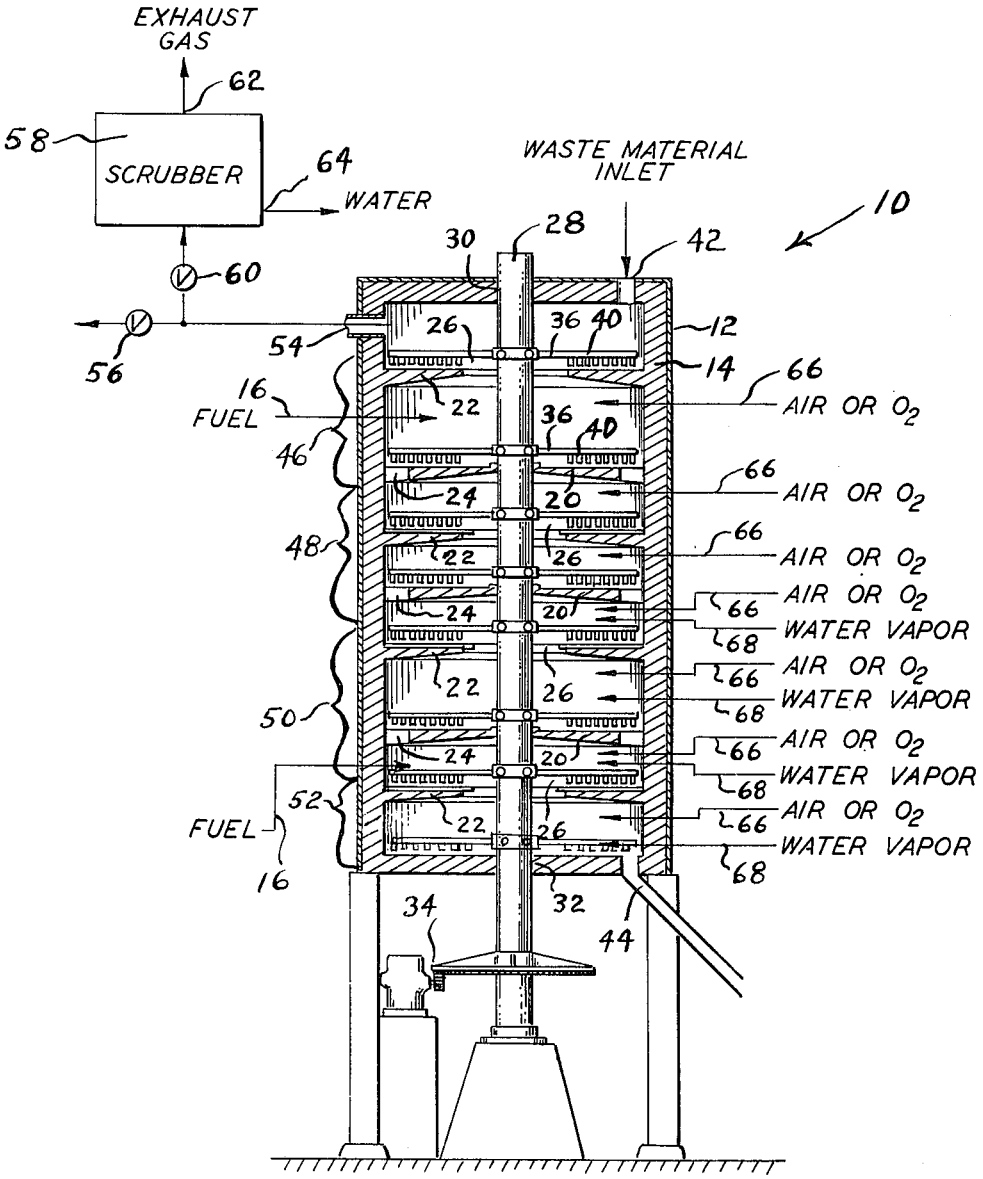
EXHAUST GAS
62
58
SCRUBBER
64
WATER
60
56
WASTE MATERIAL INLET
10
30
28
42
54
26
36
40
12
14
66
AIR OR $O_2$
16
FUEL
22
46
24
20
48
WATER VAPOR
68
50
52
34
32
44

METHOD AND APPARATUS FOR TREATING WASTE MATERIAL IN A COUNTER-CURRENT INCINERATOR

BACKGROUND OF THE INVENTION

This invention relates to incinerators and more particularly to method and apparatus for continuously incinerating waste material. The invention is particularly adapted, among other possible uses, for incinerating sewage sludge, municipal, industrial or community garbage, trash or refuse, for example.

It will be appreciated that many different types of incinerators have been employed over the years for such use including, for example, the well known Herreshoff type furnace, which is a multiple hearth type furnace having a plurality of vertically spaced hearths. In this type of furnace, the waste material is introduced at the top and moves downwardly in a generally serpentine fashion moving alternately inwardly and outwardly across the hearths and is then discharged at the bottom. While such systems have been reasonably successful, we provide in accordance with our invention, a method and apparatus for treating waste material in a counter-current incinerator, which surprisingly operates in a new and improved manner, as will become apparant as the description proceeds.

SUMMARY OF THE INVENTION

In order to accomplish the desired results, our invention provides, in one form thereof, a new and improved method for treating waste material in a counter-flow furnace wherein the waste material to be processed is introduced at one end thereof and the processed material is discharged from the other, while simultaneously the gases of combustion are caused to flow in counter-current direction with respect to the material being processed and are exhausted at said one end of the furnace. It will be appreciated that the furnace has a natural tendency to form zones of processing including sequentially from the first end of the furnace to the other end thereof, a drying zone, a charring and volatile zone, a fixed carbon burning zone, and an ash cooling zone. The method according to the invention is characterized by the step of adding an oxidant including water vapor to the fixed carbon burning zone. Quite surprisingly, we have found that by adding small quantities of water vapor or steam the carbon gasification rate is more than tripled even though the total potential oxygen concentration from air and steam is only increased by 50%. According to one aspect of the invention, only about 20% of the total oxidant volume added to the fixed carbon burning zone is steam.

The invention, in another form thereof, provides a new and improved apparatus for incinerating waste material characterized by the provision of a multiple hearth furnace having a plurality of vertically spaced hearths, a rotatable center shaft extending through the center of the furnace and passing through each hearth, a plurality of spaced rabble arms secured to the center shaft and extending radially outwardly over each hearth, alternate hearths having drop holes disposed towards the center shaft and the other hearths having drop hole disposed toward the outer periphery thereof. This furnace has an upper material inlet and a lower material dispensing outlet, as well as an upper exhaust gas outlet. The furnace has a natural tendency to form zones of processing which include sequentially from the top to the bottom, a drying zone, a charring and volatile burning zone, a fixed carbon burning zone, and an ash cooling zone. The apparatus further comprises means for adding an oxidant including air and water vapor to the fixed carbon burning zone in order to support combustion therein. According to one aspect of the invention, the waste material being treated is sewage sludge.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which the disclosure is based may readily be utilized as a basis for the designing of other methods and apparatus for carrying out the several purposes of the invention. It is important, therefore, that the claims be regarded as including such equivalent methods and apparatus as do not depart from the spirit and scope of the invention.

Specific embodiments of the invention have been chosen for purposes of illustration and description, and are shown in the accompanying drawings, forming a part of the specification.

BRIEF DESCRIPTION OF THE DRAWING

The FIGURE is a diagrammatic illustration, partially in axial, sectional elevation of a system for incinerating waste material in accordance with the concepts of our invention.

DETAILED DESCRIPTION OF THE PREFERRED EMBODIMENTS

Referring to the drawing, there is shown a multiple hearth furnace 10 of generally cylindrical configuration. Such a furnace may be of the type, for example, as described in detail in U.S. Pat. No. 3,905,757 issued Sept. 16, 1975. Thus, the furnace is constructed of a tubular outer steel shell 12, which is lined with fire brick or other similar heat resistant material 14. This furnace is provided with a plurality of burner nozzles 16, with one or more being provided on one or more of the hearths, as necessary, for initial start-up operation and for controlling the temperatures within the different regions of the furnace to carry out the particular processing desired. Any suitable type of fuel may be provided to the burners.

The interior of the furnace 10 is divided, by means of hearth floors 20 and 22, into a plurality of vertically aligned hearths, the number of hearths being preselected depending on the particular process being carried out. Each of the hearth floors is made of refractory material and is preferably of slightly arched configuration in order to be self-supporting within the furnace. Outer peripheral drop holes 24 are provided near the outer shell 12 of the furnace, and central drop holes 26 are formed in alternate hearth floors 22, near the center of the furnace. While the drawing shows the uppermost, or first, hearth as being an in-flow hearth, it will be appreciated that the concepts of our invention apply equally well to a furnace having an out-flow first hearth.

In the system illustrated in the drawing, a rotatable center shaft 28 extends axially through the furnace 10 and is secured by upper bearing means indicated at 30 and lower bearing means 32. This center drive shaft is rotatably driven by an electric motor and gear drive 34, provided for the purpose. A plurality of spaced rabble arms 36 are mounted on the center shaft 28, as at 38, and extend outwardly in each hearth over the hearth floor. The rabble arms have rabble teeth 40 formed thereon, which extend downwardly nearly to the hearth floor. The rabble teeth are inclined with respect to the longitudinal axis of their respective rabble arms so that as the rabble arms 36 are carried around by the rotation of the center shaft 28, the rabble teeth 40 continuously rake through the material being processed on the associated hearth floor and gradually urge the material toward the drop holes 24 and 26 in the hearth floors.

The material to be processed enters the top of the furnace at an inlet 42 and passes downwardly through the furnace in a generally serpentine fashion alternately inwardly and outwardly across the hearths and is discharged at the bottom of the furnace, as indicated at 44.

In effect, the furnace is divided into four zones. However, the zones are not finely segregated, but vary depending on the characteristics of the material being processed. For example, when processing sewage sludge, the first or upper zone 46, consisting of the first several hearths is a drying zone, and the second zone 48 consisting of the next several hearths is a charring and volatile burning zone. The third zone 50 is a fixed carbon burning zone, and the fourth zone 52 is an ash cooling zone.

The exhaust gases from the furnace are discharged from an outlet 54 at the top of the furnace and may be passed to other processing devices by opening valve 56, or they may be passed to a scrubber 58 by means of opening valve 60. The scrubber has an exhaust outlet 62 and a water outlet 64.

Heretofore, in order to support combustion an oxidant such as air was added at the bottom of the furnace. Additional air was added, as deemed necessary, in various other hearths throughout the furnace; particularly in the fixed carbon burning zone. Generally, it was thought necessary to operate with substantial quantities of excess air, frequently with as much as 100% excess air (above that theoretically required for supporting combustion) for purposes of providing adequate oxygen and for cooling. However, such excess air caused problems, as it tended to entrain or carry with it particulate matter into the exhaust gases, for example.

In other installations, such as the one disclosed in a copending application filed on the same date as the present application and entitled "Method and Apparatus for Incinerating Waste Material," the air supply is controlled so that on most hearths there is a deficiency of oxygen as compared to that theoretically required for complete combustion. This system has certain advantages, as indicated in said patent application.

In both of the above systems, the carbon and oxygen react, as follows: $C + O_2 \rightarrow 2CO$ or $C + O_2 \rightarrow CO_2$. Both of these reactions are exothermic, and hence add heat to the furnace at this stage.

Consideration has been given to using water as an oxidant, as it contains oxygen. However, it would be expected by one skilled in the art that water would react as follows: $H_2O + C \rightarrow CO + H_2$ which would have the disadvantage of being an endothermic reaction, thereby taking-up heat from the furnace. Quite surprisingly, we have found that by adding small quantities of steam the carbon gasification rate is more than tripled even though the total potential oxygen concentration from air and steam is only increased by 50%.

In accordance with the invention, air or oxygen is added to the furnace at various inlets 66 disposed throughout the furnace. In addition, water preferably in the form of vapor or steam is added at 68, particularly in the carbon burning zone 50. Thus, preferably of the order of about 20% of the total oxidant volume added to the carbon burning zone 50 is steam.

In order to better explain the invention, the following example is set forth:

Samples of sludge were placed in an 18 inch furnace fitted with rabble arms and teeth, and heated to dry and devolatilize the sludge. The devolatilized product served as the basis for calculation of the gasification rate (lbs./hr.-ft$^2$). The table below shows the effect on the gasification rate of air, and steam and air.

| Run No. | Temperature ° F. | Oxidant SCFM | Gasification Rate lbs./hr.-ft$^2$ |
|---|---|---|---|
| 1 | 1200 | air - 15 | 0.32 |
| 2 | 1200 | air - 4 & steam - 1 | 1.00 |

wherein SCFM = Standard Cubic Feet per Minute

While the reasons for these surprising results are not completely clear, it is presently believed that the actual reaction immediately adjacent the upper surface of the solid material bed in the fixed carbon burning zone is as follows:

$$H_2O + CO \rightarrow CO_2 + H_2$$

It is believed that normally there is a barrier of carbon monoxide gas on the surface of the fixed carbon bed, which is difficult for the oxygen to penetrate and, hence, the concentration of oxygen inside the bed is less than in the air-gas region thereabove. It will be appreciated that the carbon monoxide barrier does not react with the carbon. Now, with the foregoing reaction occuring at the surface, the carbon monoxide is at least partially converted to carbon dioxide, which does react with the carbon, thereby in effect adding another oxidant.

It will thus be seen that the present invention does indeed provide a new and improved method and apparatus for treating waste material in a counter-current incinerator, which improves the gasification rate and thereby provides cost savings with respect to furnace size, or improvements in the production rate. In addition, the system of the invention maintains a more uniform hearth temperature with substantially fewer so-called "hot spots" and, consequently, with this better control of the temperature there is reduced slagging, reduced distruction of the refractory material, and reduced corrosion of the rabble arms and teeth.

Having thus described the invention with particular reference to the preferred forms thereof, it will be obvious to those skilled in the art to which the invention pertains, after understanding the invention that various changes and modifications may be made therein without departing from the spirit and scope of the invention, as defined by the claims appended hereto.

What is claimed is:

1. A method of treating waste material in a counterflow furnace wherein the waste material to be treated is introduced at one end thereof and the treated material is discharged from the other end thereof, while simultaneously the gases of combustion are caused to flow in counter-current direction with respect to the material being processed and are exhausted at said one end of the furnace, and wherein the furnace has a natural tendency to form zones of processing including sequentially from said one end of the furnace, a drying zone, a charring and volatile burning zone, a fixed carbon burning zone, and an ash cooling zone, said method further comprising the step of adding an oxidant including water vapor to the fixed carbon burning zone.

2. A method of treating waste material according to claim 1 wherein said oxidant including water vapor is air and water vapor.

3. A method of treating waste material according to claim 2 wherein of the order of about 20% of the total oxidant volume added to the fixed carbon burning zone is steam.

4. A method of treating waste material in a multiple hearth furnace having a plurality of vertically spaced hearths, wherein the waste material is introduced to the furnace at the top thereof and moves downwardly in a generally serpentine fashion alternately inwardly and outwardly across the hearths and is discharged at the bottom of the furnace, while simultaneously the gases of combustion are caused to flow in counter-current direction wih respect to the material being processed and are exhausted at the top of the furnace, and wherein the furnace has a natural tendency to form zones of processing including sequentially from the top of the furnace to the bottom thereof, a drying zone, a charring and volatile burning zone, a fixed carbon burning zone, and an ash cooling zone, said method further comprising the steps of adding air and water vapor in the fixed carbon burning zone.

5. A method of treating waste material according to the claim 4 wherein said waste material is slewage sludge.

6. A method of treating waste material according to claim 4 wherein of the order of about 20% of the total oxidant volume of the air and water vapor added to the fixed carbon burning zone is steam.

7. A method of treating waste material according to claim 4 wherein the quantity of air added to said fixed carbon burning zone is below that theoretically required for complete combustion of the material being processed.

8. Apparatus for treating waste material comprising, in combination, a multiple hearth furnace having a plurality of vertically spaced hearths, a rotatable center shaft extending through the center of the furanace and passing through each hearth, a plurality of spaced rabble arms secured to the center shaft and extending radially outwardly over each hearth, alternate hearths having drop holes disposed towards the center shaft and the other hearths having drop holes disposed toward the outer periphery thereof, said furanace having an upper material inlet and a lower material dispensing outlet, and said furnace having an upper exhaust gas outlet, said furnace having a natural tendency to form zones of processing including sequentially from the top thereof to the bottom, a drying zone, a charring and volatile burning zone, a fixed carbon burning zone and an ash cooling zone, and means for adding an oxidant including air and water vapor to the fixed carbon burning zone.

* * * * *